US011278087B1

(12) United States Patent
Humbert, Jr. et al.

(10) Patent No.: US 11,278,087 B1
(45) Date of Patent: Mar. 22, 2022

(54) RING RE-SIZING ATTACHMENT

(71) Applicant: John Humbert, Jr., Barnegat, NJ (US)

(72) Inventors: John Humbert, Jr., Barnegat, NJ (US); John P. Humbert, Sr., Morganville, NJ (US); Robert James Mosley, San Jose, CA (US); Lena Qin, Fremont, CA (US); Timothy Lee Sauder, Mountain View, CA (US)

(73) Assignee: John Humbert, Jr., Barnegat, NJ (US)

( * ) Notice: Subject to any disclaimer, the term of this patent is extended or adjusted under 35 U.S.C. 154(b) by 0 days.

(21) Appl. No.: 16/871,180

(22) Filed: May 11, 2020

(51) Int. Cl.
*A44C 9/02* (2006.01)

(52) U.S. Cl.
CPC ..... *A44C 9/02* (2013.01)

(58) Field of Classification Search
CPC ..... A44C 9/02
USPC ..... 63/15.5, 15.6, 15.65
See application file for complete search history.

(56) References Cited

U.S. PATENT DOCUMENTS

| | | | | |
|---|---|---|---|---|
| 2,532,354 | A | 12/1950 | Hirsh | |
| 2,615,314 | A * | 10/1952 | Axel | A44C 9/02 63/15.6 |
| 2,615,315 | A | 10/1952 | Axel | |
| 2,787,142 | A | 4/1957 | Axel | |
| 3,362,189 | A | 1/1968 | DeSanto | |
| 3,380,263 | A | 4/1968 | Nathan | |
| 3,460,356 | A | 8/1969 | Lodrini | |
| 3,933,010 | A | 1/1976 | Ulbrich | |
| 4,480,447 | A | 11/1984 | Lodrini | |
| 5,239,842 | A | 8/1993 | Gesensway | |
| 6,003,334 | A | 12/1999 | Miller | |
| 6,192,708 | B1 | 2/2001 | Mitchell | |
| 6,748,764 | B1 | 6/2004 | Roemer | |
| 7,150,164 | B2 | 12/2006 | Sills | |
| 7,409,837 | B2 | 8/2008 | Smith | |
| 7,526,864 | B1 | 5/2009 | Eisner | |
| 9,775,415 | B1 | 10/2017 | Humbert, Jr | |
| 10,182,625 | B1 | 1/2019 | Humbert, Jr | |
| 2006/0162380 | A1 | 7/2006 | Czajka | |
| 2007/0137249 | A1 | 6/2007 | Czajka | |
| 2010/0083701 | A1 | 4/2010 | Huynh | |
| 2012/0180523 | A1 * | 7/2012 | Meyerhoff | A44C 9/02 63/15.6 |

(Continued)

FOREIGN PATENT DOCUMENTS

| | | |
|---|---|---|
| CN | 202445263 U | 9/2012 |
| DE | 20218002 U1 | 1/2003 |

*Primary Examiner* — Jack W Lavinder
(74) *Attorney, Agent, or Firm* — Rogowski Law LLC

(57) ABSTRACT

One or more ring re-sizing attachments are appended to the internal circumference of a ring band so that a ring band large enough to pass over a knuckle remains comfortably fit around the finger below the knuckle. Each attachment includes a base defining an internal volume surrounded by a raised wall. A button slidingly engaged in the base internal volume defines an inner volume, and one or more springs are held in the button inner volume. As the one or more springs are compressed, the button moves into the internal volume of the base, increasing the space within the band to move the band beyond a knuckle. Once the band is beyond the knuckle, the spring(s) urge the button upwardly, causing the lips of the button to contact ledges or lips projecting from the sidewall of the base, to tighten the fit of the ring band around the finger.

29 Claims, 9 Drawing Sheets

(56) References Cited

U.S. PATENT DOCUMENTS

| | | | |
|---|---|---|---|
| 2013/0247612 | A1 | 9/2013 | Yan |
| 2014/0326022 | A1 | 11/2014 | Tosyali |

* cited by examiner

RING RE-SIZING ATTACHMENT

BACKGROUND

The present invention relates to jewelry, and particularly ring re-sizing attachments that may be appended to the bands of rings to enable persons with smaller finger diameters to wear rings of larger ring size without removing material from the ring band.

Jewelry wearers may develop large knuckles due to aging, arthritis or weight gain. Or, jewelry wearers may change ring size due to weight loss. Or, rings that were fit to another family member may be too large for the current wearer. All of these situations may cause a ring owner to consult with a jeweler to change the size of a ring.

When a ring is made or adjusted to fit over an enlarged knuckle, it may then be too large for the digital portion of the ring finger and will tend to turn on the finger. This makes the ring uncomfortable, and can harm the setting.

When a ring is re-sized by removing metal material to reduce, or adding metal material to enlarge, the ring band circumference; there are limits to the amount that ring bands may be stretched or cut down without weakening the ring structure and integrity or introducing imperfections. It also is expensive to pay a jeweler to enlarge or reduce the size of a ring band.

Mechanisms to re-size a ring band are shown in the prior art. Some ring re-sizing mechanisms seat a spring wire into a groove formed in the ring band, or append a spring wire to the inside of the band. U.S. Pat. No. 3,933,010 (Ulbrich) creates an internal groove in the ring band and inserts a profile wire ring inside. U.S. Pat. No. 3,460,356 (Lodrini) similarly modifies the ring band to have a groove to receive an auxiliary band. See also U.S. Published patent application US2010/0083701 A1 (Huynh) showing a spring of an arc of 210-270 degrees secured to the inside circumferential surface of the bottom of a ring band.

Some ring re-sizing mechanisms comprise a specialized ring band that includes a combination of springs. See U.S. Pat. No. 6,748,764 (Roemer)

Some ring re-sizing mechanisms drill holes into the ring band to seat leaf springs or other spring elements. U.S. Pat. No. 4,480,447 (Lodrini) shows a leaf spring received in slots in the ring band, where the leaf spring urges a saddle-shaped insert away from the inner circumference of the ring band. German Utility Model DE20218002 (U10 shows a pressure pad with a spring 30 that is positioned on a ring band. U.S. Pat. No. 7,150,164 (Sills) appends an air bladder to the inner ring band, and adjusts the ring size by expanding or contracting the size of the air bladder by introducing air through a valve.

While various types of ring re-sizing mechanisms are known in the prior art, the primary mechanism used commercially today by jewelers is to weld beads of metal into the ring band of a size that is large enough to pass a wearer's knuckle. The metal beads create pressure points against a wearer's finger to hold the ring in place on the finger beyond the knuckle. These pressure points are not comfortable, and the welding of metal weakens or mars the metal of the ring band.

Certain improvements to ring re-sizing mechanisms are shown in U.S. Pat. Nos. 10,182,625 and 9,775,415. In these patents, telescoping buttons are joined to a base with a spring to urge the buttons away from the base.

There is still a need for improving the way ring sizes are modified without harming the appearance or integrity of the ring band, and providing greater user comfort. Lower cost options are also sought. The present invention fulfills these needs and provides further related advantages, as described herein.

BRIEF SUMMARY

According to one preferred embodiment, a ring re-sizing attachment has a base having a bottom surface and having a top surface opposite the bottom surface. The base defines an inner cavity with a raised wall surrounding said inner cavity, and has a first lip and a second lip projecting from the raised wall into the inner cavity. The ring re-sizing attachment further includes a button that is slidingly engaged within the inner cavity of the base. The button has an arcuately curved top surface, a bottom surface opposite the top surface and a sidewall depending downwardly from the top surface. The button has a left end and a right end and a lip at the left end and a second lip at the right end. The button defines an inner volume, optionally into which at least two support ribs project from the bottom surface of the button. The lips at the ends of the button are directed outwardly and away from the inner volume of the button. A leaf spring is arranged in the inner cavity of the base. The leaf spring has an arcuately curved top surface and a bottom surface opposite the arcuately curved top surface. The leaf spring has a first tip end that contacts the button and a second tip end that contacts the button. A bottom cover extends over at least the inner cavity of the base to retain the leaf spring in the inner cavity of the base. The leaf spring urges the button away from the bottom cover so that a portion of the button projects above the raised wall of the base. When the button is forced downwardly to compress the leaf spring, the leaf spring remains in the inner volume of the button when the leaf spring is compressed.

In one advantageous embodiment, the first tip end and the second tip end of the leaf spring are curved. In such embodiment the curved tip end surfaces contact the the button. In an especially advantageous embodiment, the button has support ribs depending from the bottom surface, and the tip ends of the leaf spring contact the support sibs. For example, the button may have a pair of support ribs depending from the bottom surface at one end, and a second pair of support ribs depending from the bottom surface at the other end. One curved tip end of the leaf spring contacts the first pair of support ribs and the second curved tip end of the leaf spring contacts the second pair of support ribs. The leaf spring thus loads the button at four point contacts, better distributing the pushing force from the spring onto the button and better maintaining smooth, jam-free operation.

As the button is urged upwardly within the inner cavity of the base, the lip at the left end and the second lip at the right end, respectively, contact the first lip and the second lip of the raised wall surrounding the inner cavity. The lips of the raised wall surrounding the inner cavity retain the lips of the button in the inner cavity. When a pressing force is applied to the top surface of the button, the leaf spring is compressed, and the button is urged into the inner cavity of the base. In an advantageous embodiment, the sides of the button slidingly engage with the inner sidewall of the raised wall of the inner cavity, and the lower edges of such button sides and button lips may be held adjacent to or in contact with the bottom cover. In such embodiment, the raised wall of the base defines a height, and the button defines a height that is substantially the same as the height of the raised wall of the base. In such embodiment, the arcuately curved top surface of the button is at or below the height of the raised wall of the base when the button is pushed downwardly overcoming the opposite force of the leaf spring.

If present, the support ribs projecting away from the bottom surface of the button may have bent tips. The first tip end of the leaf spring is retained between the bent tip of one of the support ribs and the right end of the button. In such embodiment, the second tip end of the leaf spring is retained between the bent tip of a second one of the support ribs and the left end of the button.

In other embodiments, the spring may be selected from a leaf spring, a torsional spring, a coil spring and a living hinge. One or multiple springs may be inserted into the inner cavity of the button to urge the button away from the bottom surface of the base of the ring re-sizing attachment. For example, two torsional springs may be inserted, with a first spring having spring arms acting on one end of the button, and with a second spring having spring arms acting on the opposite end of the button. For another example, a portion of the base may flex as a living hinge to urge the button away from the bottom surface of the base.

An adhesive may be applied to the bottom surface of the bottom cover to append the bottom cover to the inner circumferential surface of a ring band. Optimally, the width of the base is equal to or less than the width of a ring band to which the ring re-sizing attachment is to be appended.

The base and button may be formed of a polymer or thermoplastic material, such as polyether ether ketone (PEEK), polycarbonate (PC), polyoxymethylene (Delrin), Acrylonitrile butadiene styrene (ABS). Alternatively, the base and button may be formed of a metal or a precious metal, such as gold, platinum, silver, and alloys of precious metals. The bottom cover may be an elastomeric or metal sheet or film.

Another preferred embodiment of the invention is a jewelry ring in combination with one or more of the inventive ring re-sizing attachments. The jewelry ring has a band adapted to fully or substantially fully encircle a user's finger when the jewelry ring is worn. At least one ring re-sizing attachment is appended to an inner circumferential surface of the band. The bottom cover of the ring re-sizing attachment may be adhered to the band. Preferably, the base and the top surfaces of the buttons are arcuate, and of a shape to complement or match the curve of the inner circumferential surface of the ring band.

In an advantageous embodiment, two ring re-sizing attachments are appended to the inner circumferential surface of the band of the jewelry ring at different locations, spaced apart from one another. Where the ring band is circular, the first ring re-sizing attachment may be appended or joined to the inner circumference at a location approximately 95 degrees to 175 degrees from a predetermined reference point and the second ring re-sizing attachment is spaced apart from the first ring re-sizing attachment, and appended or joined to the inner circumference at a location approximately 185 to 265 degrees around the circle from the predetermined reference point.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
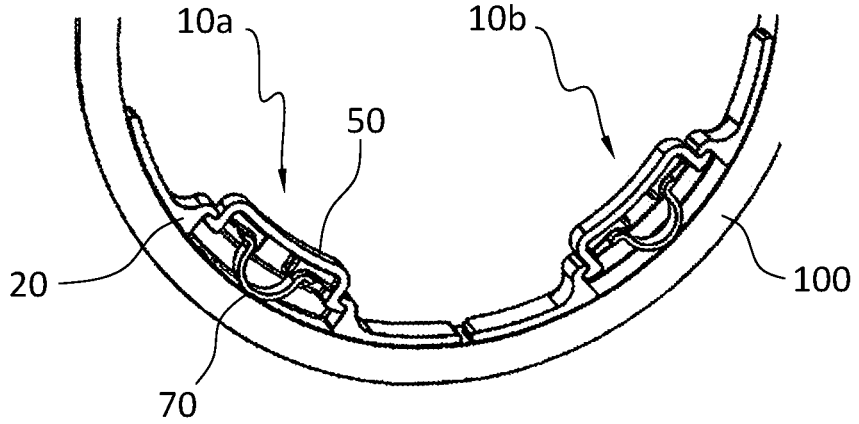
FIG. 1 is a cross-sectional view in front elevation taken along line 1-1 of FIG. 6 of a portion of a jewelry ring band to which two ring re-sizing attachments according to the invention are appended.

Reference will now be made in detail to the present embodiments of the invention illustrated in the accompanying drawings. The same or like reference numbers may be used in the drawings to refer to the same or like features. It should be noted that the drawings are in simplified form and not drawn to a precise scale.

In reference to the disclosure herein, for purposes of convenience and clarity only, directional terms such as top, bottom, above, below, front, rear, right, left, inner, and outer, are used with respect to the accompanying drawings. Such directional terms used in conjunction with the following description of the drawings should not be construed to limit the scope of the invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Figure 6:
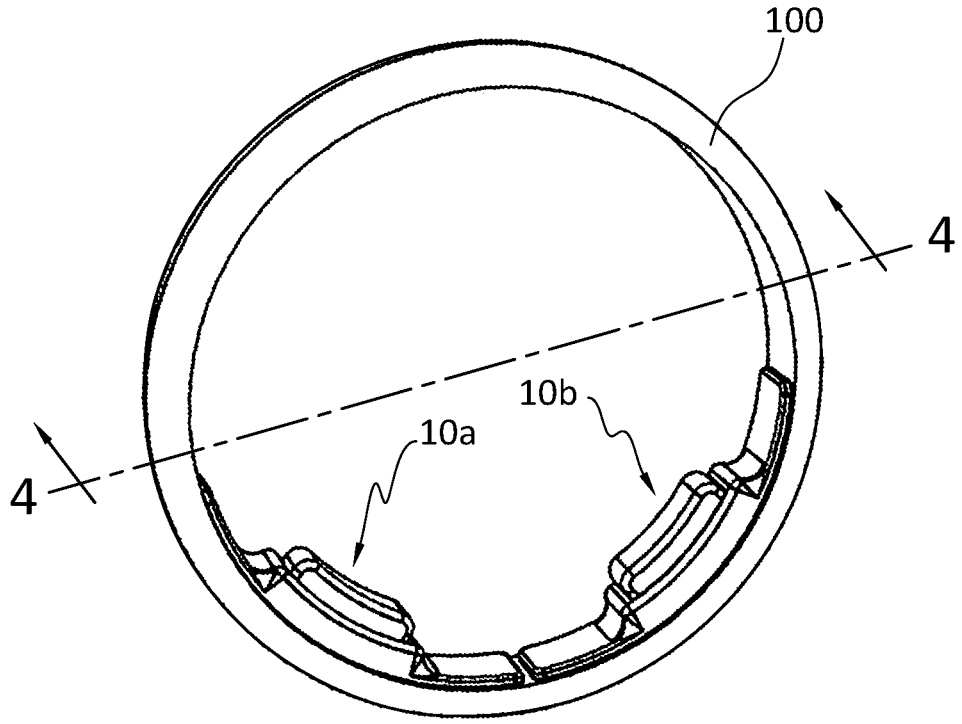
FIG. 6 is a right front perspective view of a jewelry ring to which the two ring re-sizing attachments according to FIG. 1 have been appended.
Figure 7:
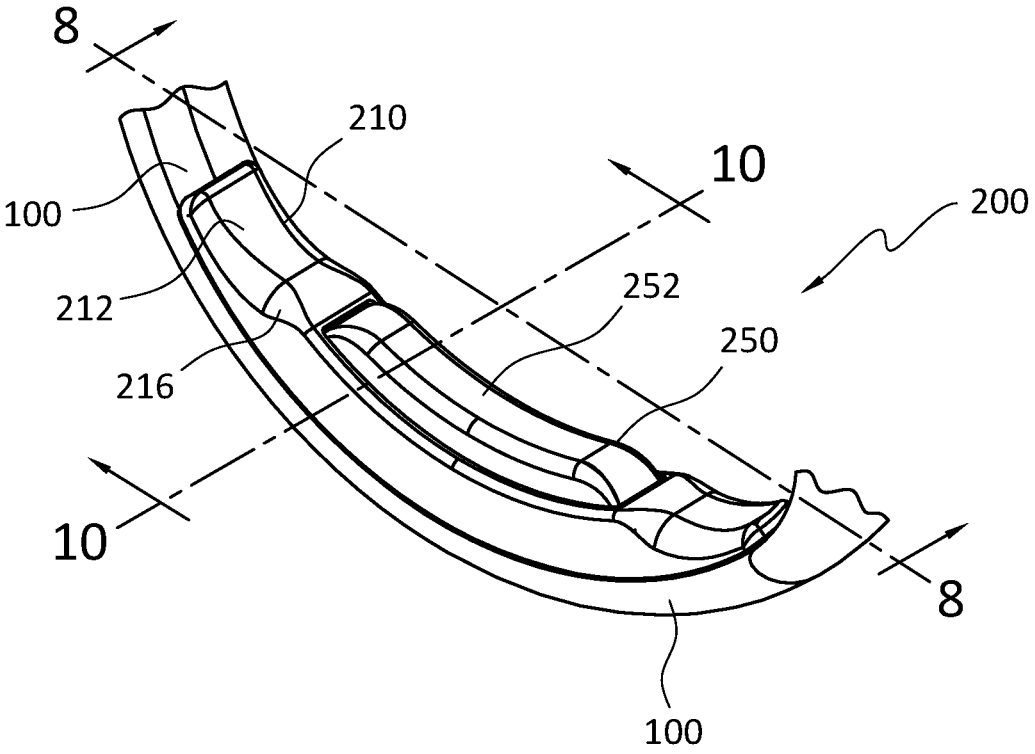
FIG. 7 is a right front perspective view of a portion of a jewelry ring band to which a ring re-sizing attachment according to a second embodiment of the invention has been appended.

Turning in detail to the drawings, FIGS. 1 and 6 show two ring re-sizing attachments 10*a* and 10*b* attached to a jewelry ring band 100. The ring re-sizing attachments 10*a*, 10*b* are appended to the jewelry ring band 100 with suitable adhesive, such as E6000 medium viscosity industrial perchloroethylene adhesive.

Figure 2:
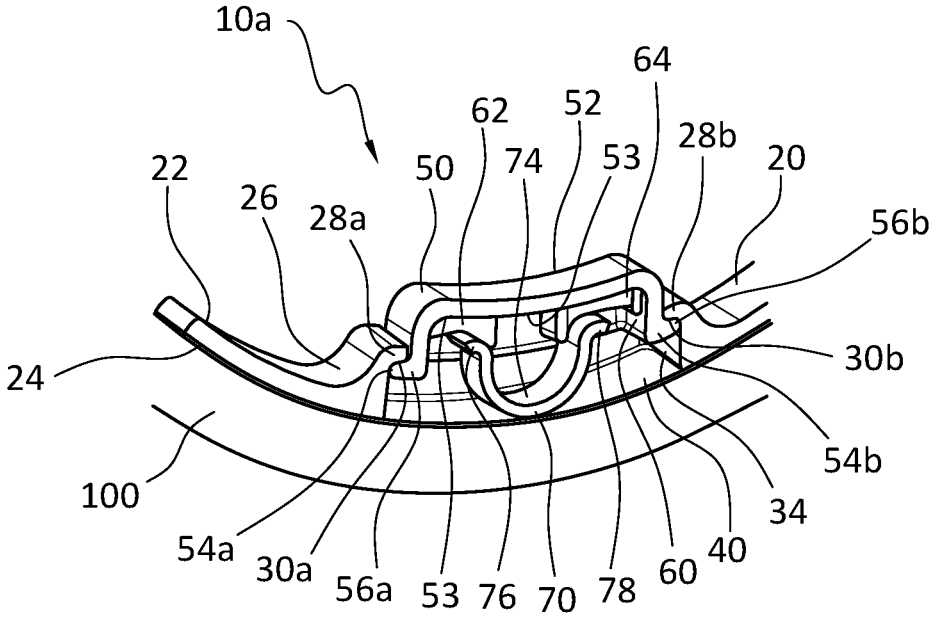
FIG. 2 is an enlarged cross-sectional view in front elevation of one ring re-sizing attachment of FIG. 1.
Figure 3:
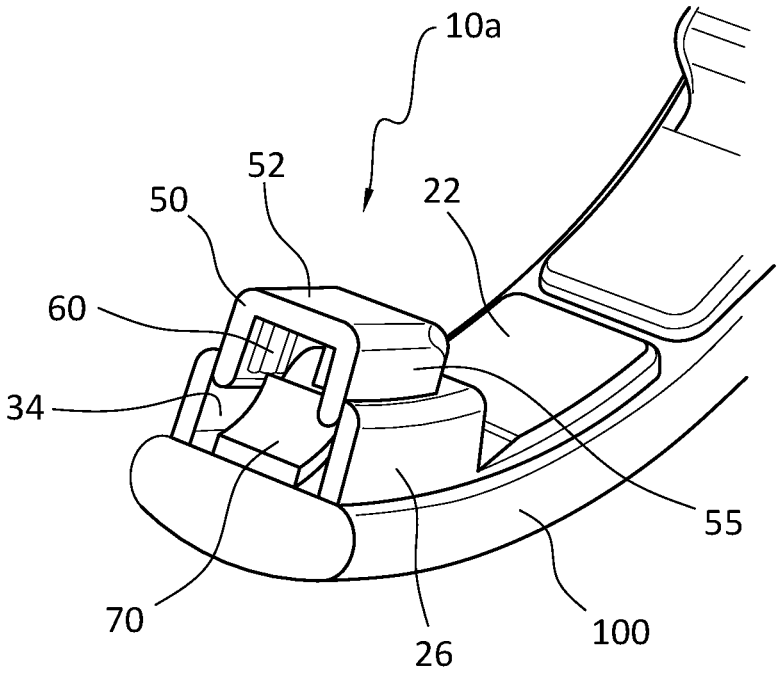
FIG. 3 is an enlarged cross-sectional view in right perspective taken along line 3-3 in FIG. 6 of one ring re-sizing attachment of FIG. 1.

Referring to FIGS. 2 and 3, the ring re-sizing attachment 10*a* has a base 20 with a top surface 22 and a bottom surface 24 opposite the top surface. The base 20 further has a raised wall 26 upstanding from the top surface 22 that surrounds an inner cavity 34 of the base 20. The raised wall 26 defines a curved lip 28*a* at its left end and a curved lip 28*b* at its right end. The bottom surfaces of the curved lips 28*a*, 28*b* form inner ledges 30*a*, 30*b*. The bottom surface 24 of the base 20 preferably is curved to match the curve of an inner circumferential surface of a jewelry ring band 100.

The inner cavity 34 of the base 20 is closed off by a bottom cover 40. The bottom cover 40 may be an elastomeric sheet or polymeric sheet. Adhesive may be applied to append the bottom cover 40 to an inner circumferential surface of a jewelry ring band 100 thereby securing the ring re-sizing attachment to the jewelry ring band 100.

Figure 4:
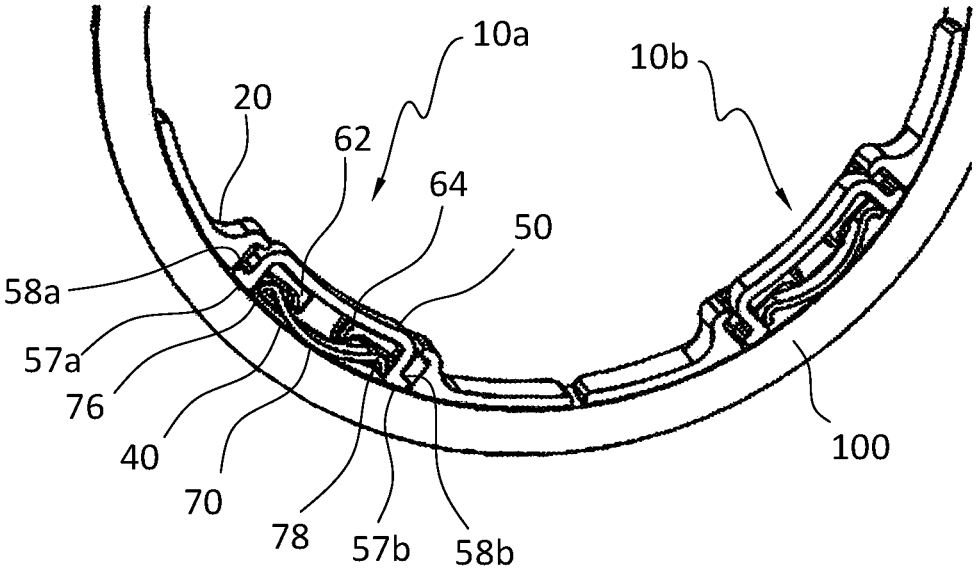
FIG. 4 is a cross-sectional view in front elevation taken along line 4-4 of FIG. 6 of a portion of a jewelry ring band to which two ring re-sizing attachments according to the invention are appended, in which buttons of the ring-resizing attachments are compressed downwardly.

A button 50 has an arcuately curved upper or top surface 52 with a bottom surface 53 opposite the top surface 52. The button 50 has dimensions to slidingly fit within an opening defined by the raised sidewall 26 of the base 20. The sidewalls of the button 50 are positioned closely adjacent to the inner portion of the raised sidewall 26 of the base 20. The ends 54*a*, 54*b* of the button 50 have curved lips 56*a*, 56*b* projecting outwardly from the bottom edges of the ends 54*a*, 54*b*. The curved lips 56*a*, 56*b* have generally planar top surfaces forming ledges 58*a*, 58*b* adapted for contacting the inner ledges 30*a*, 30*b*, respectively, of the curved lips 28*a*, 28*b* of the raised wall 26 of the base 20. As shown in FIG. 4, the curved lips 56*a*, 56*b* have bottom contact surfaces 57*a*, 57*b*. The button 50 is retained in the cavity 34 of the base 20 by contact between the ledges 58*a*, 58*b* and the inner ledges 30*a*, 30*b*. The retention features of the button 50 are present only on the button ends (i.e., circumferentially with reference to a jewelry ring band), and not along the sides of the button. With retention features so positioned, the button may be wider, leading to greater wearer comfort due to greater button surface area in contact with the wearer's finger.

The button 50 defines an inner cavity 60. In the embodiment shown in FIGS. 1-5, a first pair of support ribs 62 project from the bottom surface 53 of the button 50 into the inner cavity 60 of the button 50. A second pair of support ribs 64 project from the bottom surface 53 of the button 50 into the inner cavity 60 of the button 50. The first pair of support ribs 62 are aligned parallelly to one another, spaced apart, and have a L-shape configuration. The second pair of support ribs 64 are aligned parallelly to one another, spaced apart, and have an L-shaped configuration. A first recess 66 is formed between the foot of the "L"s of the first pair of support ribs 62 and the inner side wall of the button inner cavity 60. A second recess 68 is formed between the foot of the "L"s of the second pair of support ribs 64 and the inner sidewall of the button inner cavity 60.

A leaf spring 70 is inserted into the inner cavity 34 of the base 20 with the tips 76, 78 of the leaf spring held in the inner cavity 60 of the button 50. The leaf spring 70 is arcuately curved, and has a top surface 74 and a bottom surface 72 opposite from the top surface 74. The tips 76, 78 terminate in outwardly downturned curved tip ends. The outwardly downturned curved tip ends of the leaf spring 70 are held in the first recess 66 and second recess 68, respectively. The curved free ends of the leaf spring 70 encourage smooth travel upon the interior of the button 50, and are especially advantageous because they resist scratching/gouging of the interior of the button 50. The smooth operation makes the invention particularly useful for wearers who remove and replace the ring 100 multiple times, therein exercising the leaf spring 70 through its sliding travel as the ring 100 is removed and replaced.

As shown in FIGS. 1, 2 and 3, the leaf spring 70 urges the button 50 upwardly so that the top surface 52 of the button 50 extends above the upraised sidewall 26 of the base 20. The ledges 58*a*, 58*b* of the button 50 contact the inner ledges 30*a*, 30*b* of the upraised sidewall 26 of the base, retaining a bottom portion of the button 50 within the inner cavity 34 of the base 20. The tips 76, 78 contact the support ribs 62, 64, creating four point contacts with the button 50. The four point contacts distribute the pushing force over the button 50, making the button 50 more resistant to jamming as the button 50 slidingly moves up (and down) within the inner cavity 34 of the base 20. The four point contacts also provide greater stability as the button 50 is confronted with side impacts or side forces on the button 50 as would be encountered when the jewelry ring to which the ring re-sizing attachment(s) 10*a*, 10*b* have been appended is inserted over a user's finger.

When the button 50 is urged downwardly against the leaf spring 70, the outwardly downturned curved tip ends 76, 78 of the leaf spring 70 slide in the respective recesses 66, 68 toward the ends of the button 50. The leaf spring 70 substantially flattens, as the tips 76, 78 remain in contact with the support ribs 62, 64 of the button 50. The outwardly downturned curved tip ends 76, 78 allow the leaf spring 70 to translate along the support ribs 62, 64 inside the button 50 as the leaf spring is compressed. The bottom edges of the button 50, such as the bottom ledge contact surfaces 57*a*, 57*b*, move downwardly farther into the inner cavity 34 of the base 20. The button 50 is fully depressed within the cavity of the base 20 when the bottom ledge contact surfaces 57*a*, 57*b* contact the bottom cover 40 (see FIG. 4). The compressed leaf spring 70 seats within the inner cavity 60 of the button 50 and does not block the button 50 from achieving its maximum travel in compressed state.

The leaf spring 70 is designed to exert an appropriate pressure upon the wearer's finger to hold the ring in position. The leaf spring is also designed to resist plastic deformation/permanent set during use so that its travel and pressure remain unchanged over the use life of the product. To achieve this, the leaf spring may be constructed from metal or plastic. The leaf spring may be its own unique component in the assembly, or it may be integrated as appropriate into adjacent components and may include "living" spring features. The leaf spring may appear rectangular in planform, or it may feature notches and/or varying widths/thicknesses to modify its spring rate to achieve appropriate pressure upon the wearer's finger. The leaf spring may also heat treated, either uniformly or variably, to modify its spring rate and/or resistance to plastic deformation.

Figure 5:
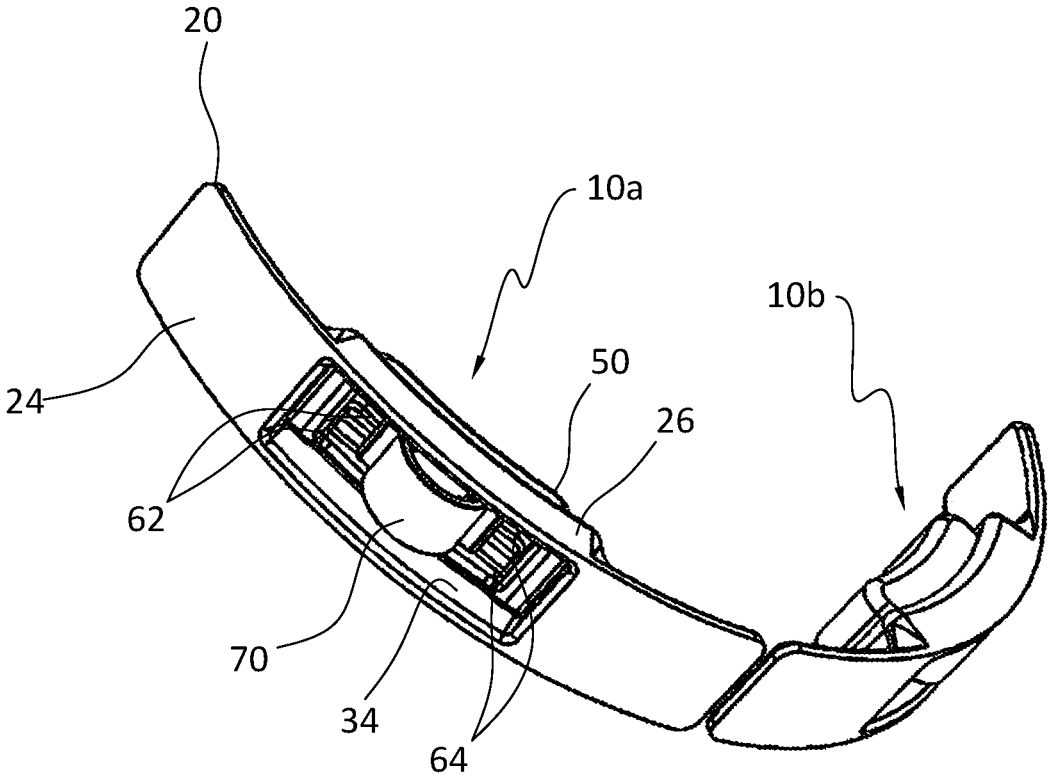
FIG. 5 is a bottom right perspective view of two ring re-sizing attachments according to the invention with bottom covers removed therefrom.

As best seen with reference to FIG. 5, the ring re-sizing attachment 10*a*, 10*b* of the first embodiment may be assembled by first inserting the button 50 into the inner cavity of the base 20 from the bottom side 24 of the base 20. Then, the leaf spring 70 may be placed into the inner cavity 60 of the button and the inner cavity 34 of the base 20. The inner cavity 34 of the base 20 is then covered by the bottom cover 40 (not shown in FIG. 5), thereby holding the leaf spring 70 and the button 50 within the inner cavity 34 of the base 20.

The button 50 and base 20 may be formed of polymers, precious metals and/or metals. Suitable precious metals include gold, gold alloys, silver, silvery alloys, platinum, and platinum alloys. Suitable metals include stainless steel. Suitable polymers include moldable thermosetting plastics and polyurethanes.

Referring next to FIGS. 7-11, a second embodiment of a ring re-sizing attachment 200 is appended to a surface of a jewelry ring band 100. Preferably, two such ring re-sizing attachments 200*a*, 200*b* (see FIG. 11) are attached to the band 100 in spaced apart relation, such as at the 4 o'clock and 8 o'clock locations on the inner surface of the band. Each ring re-sizing attachment 200 has a base 210 with a top surface 212 and a bottom surface 214 opposite the top surface. The base 210 further has a raised wall 216 upstanding from the top surface 212 that surrounds an inner cavity 222 of the base 210. The raised wall 216 defines a curved lip 218*a* at its left end and a curved lip 218*b* at its right end. The bottom surfaces of the curved lips 218*a*, 218*b* form inner ledges 220*a*, 220*b*. The bottom surface 214 of the base 210 preferably is curved to match the curve of an inner circumferential surface of a jewelry ring band 100.

The inner cavity 222 of the base 210 is closed off by a bottom cover 240. The bottom cover 240 may be an elastomeric sheet or polymeric sheet. Adhesive may be applied to append the bottom cover 240 to an inner circumferential surface of a jewelry ring band 100 thereby securing the ring re-sizing attachment to the jewelry ring band 100.

Figure 8:
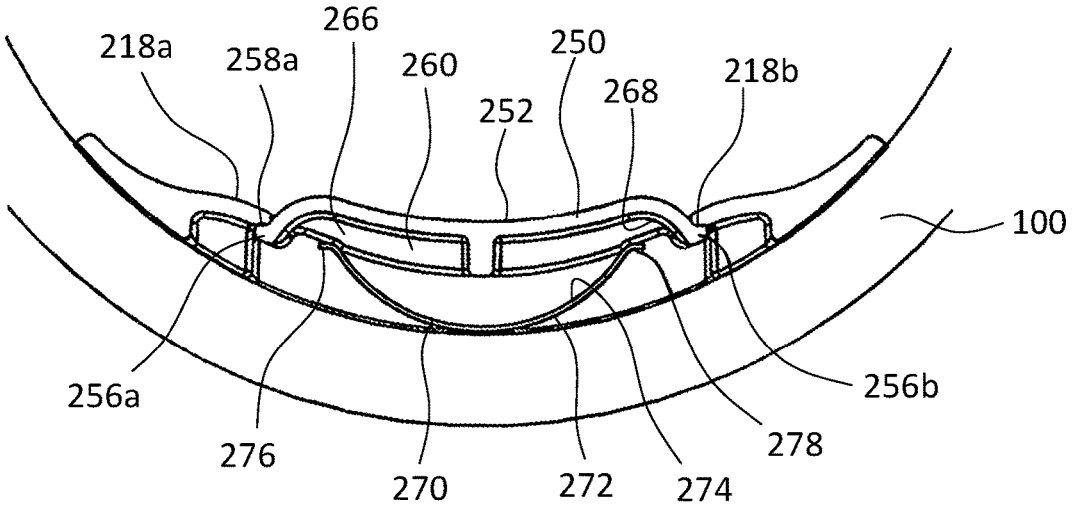
FIG. 8 is a cross sectional view taken along line 8-8 in FIG. 7.
Figure 9:
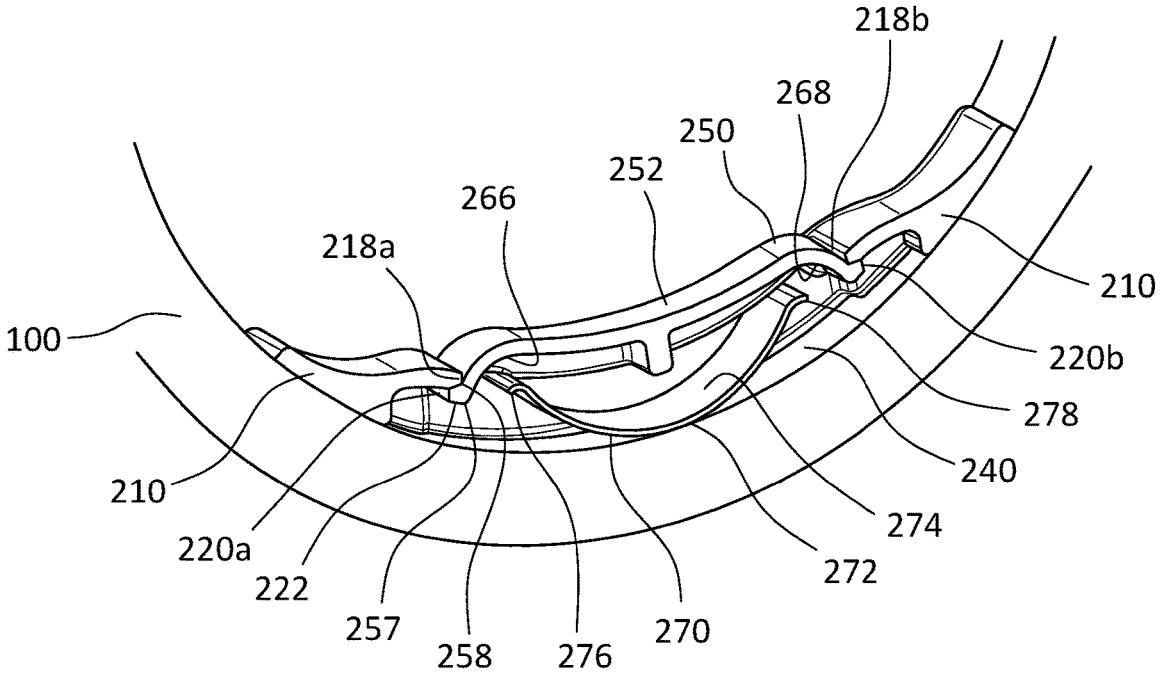
FIG. 9 is a cross sectional view of the portion of the jewelry ring band and ring re-sizing attachment of FIG. 7.
Figure 10:
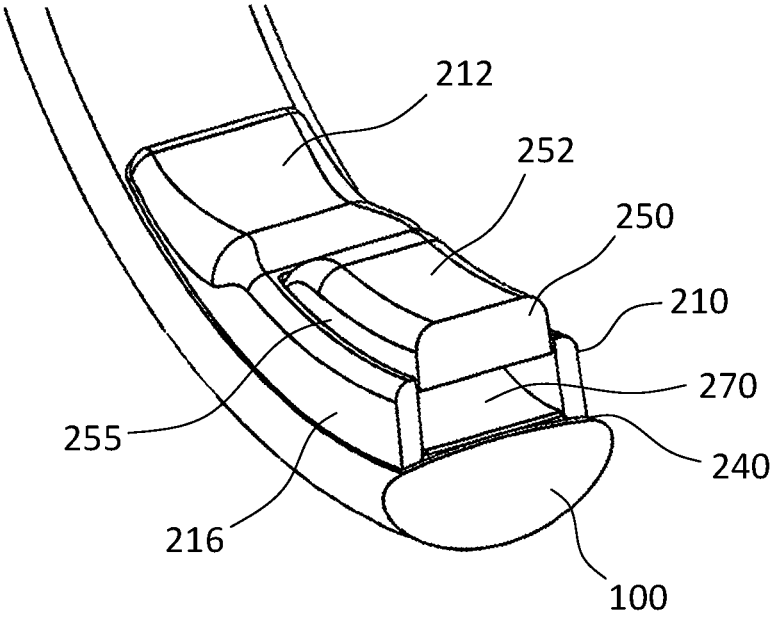
FIG. 10 is a cross-sectional view taken along line 10-10 in FIG. 7.

A button 250 has an arcuately curved upper or top surface 252 with a bottom surface 253 opposite the top surface 252. The button 250 has dimensions to slidingly fit within an opening defined by the raised sidewall 216 of the base 210. The sidewalls of the button 250 are positioned closely adjacent to the inner portion of the raised sidewall 226 of the base 210. The ends 254*a*, 254*b* of the button 250 have curved lips 256*a*, 256*b* projecting outwardly from the bottom edges of the ends 254*a*, 254*b*. The curved lips 256*a*, 256*b* have generally planar top surfaces forming ledges 258*a*, 258*b* adapted for contacting the inner ledges 220*a*, 220*b*, respectively, of the curved lips 218*a*, 218*b* of the raised wall 216 of the base 210. As shown in FIGS. 8 and 9, the curved lips 256*a*, 256*b* have bottom contact surfaces 257*a*, 257*b*. The button 250 is retained in the cavity 222 of the base 210 by contact between the ledges 258*a*, 258*b* and the inner ledges 220*a*, 220*b*. The retention features of the button 250 are present only on the button ends (i.e., circumferentially with reference to a jewelry ring band), and not along the sides of the button. With retention features so positioned, the button may be wider, leading to greater wearer comfort due to greater button surface area in contact with the wearer's finger.

The button 250 defines an inner cavity 260. In the embodiment shown in FIGS. 7-11, the bottom surface 253 of the button 250 extending into the inner cavity 260 of the button 250 is curved and the button 250 is thicker (has more material) at the curved middle portion than at the button ends 254*a*, 254*b*.

In this second embodiment, a leaf spring 270 is inserted into the inner cavity 222 of the base 210 with the tips 276, 278 of the leaf spring held in the inner cavity 260 of the button 250. The leaf spring 270 is arcuately curved, and has a top surface 274 and a bottom surface 272 opposite from the top surface 274. The tips 276, 278 terminate in outwardly downturned curved tip ends. The outwardly downturned curved tip ends of the leaf spring 270 are held in spring-retaining first recess 266 and second recess 268, respectively, formed inside the inner cavity 260 of the button 250. The curved free ends of the leaf spring 270 encourage smooth travel upon the interior of the button 250, and are especially advantageous because they resist scratching/gouging of the interior of the button 250. The smooth operation makes the invention particularly useful for wearers who remove and replace the ring 100 multiple times, therein exercising the leaf spring 270 through its sliding travel as the ring 100 is removed and replaced.

As shown in FIGS. 8 and 9, the leaf spring 270 urges the button 250 upwardly so that the top surface 252 of the button 250 extends above the upraised sidewall 216 of the base 210. The ledges 258*a*, 258*b* of the button 250 contact the inner ledges 220*a*, 220*b* of the upraised sidewall 216 of the base 210, retaining a bottom portion of the button 250 within the inner cavity 222 of the base 210. The tips 276, 278 contact the curved bottom surface 253 of the button 250, particularly within the spring-retaining first recess 266 and second recess 268. The contacts between the tips 276, 278 and the bottom surface 253 distribute the pushing force over the button 250, making the button 250 more resistant to jamming as the button 250 slidingly moves up (and down) within the inner cavity 222 of the base 210. These contacts also provide greater stability as the button 250 is confronted with side impacts or side forces on the button 250 as would be encountered when the jewelry ring to which one or more ring re-sizing attachment(s) 200 have been appended is inserted over a user's finger.

Figure 11:
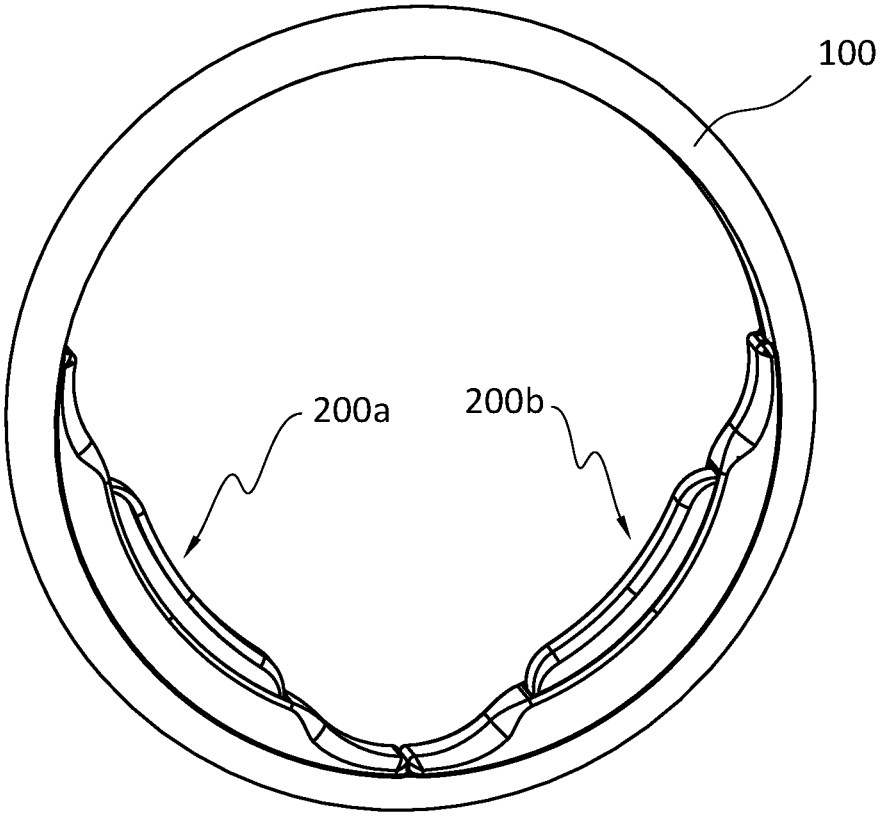
FIG. 11 is a right front perspective view of a jewelry ring to which the two ring re-sizing attachments according to FIG. 7 have been appended.
Figure 12:
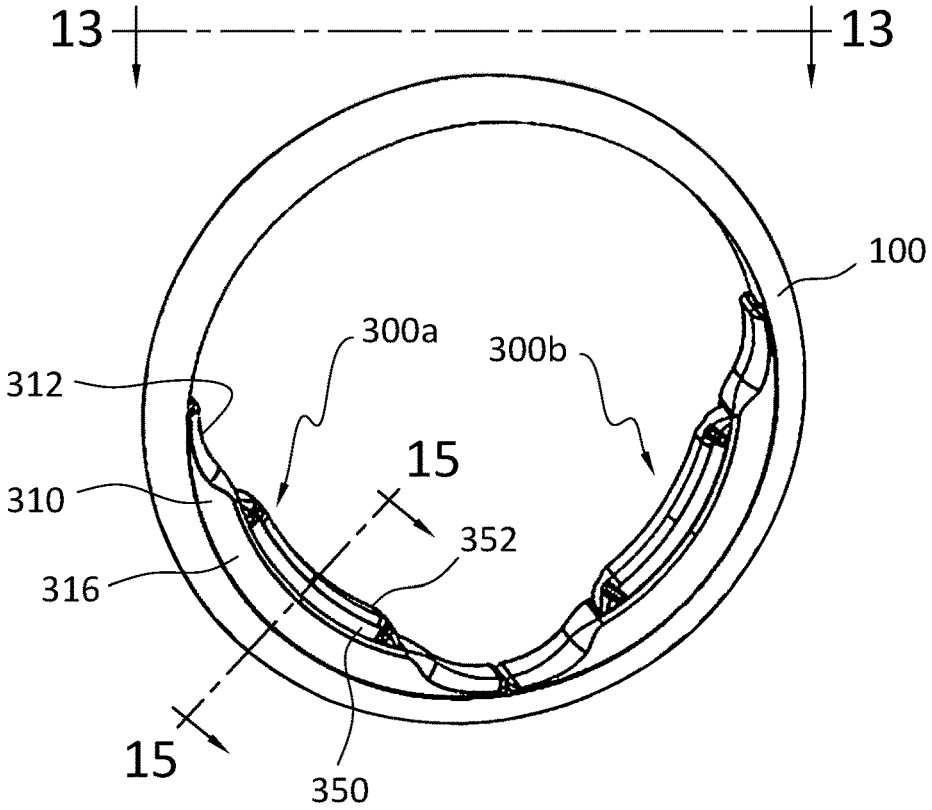
FIG. 12 is a right front perspective view of a jewelry ring to which two ring re-sizing attachments according to a third embodiment of the invention has been appended.
Figure 13:
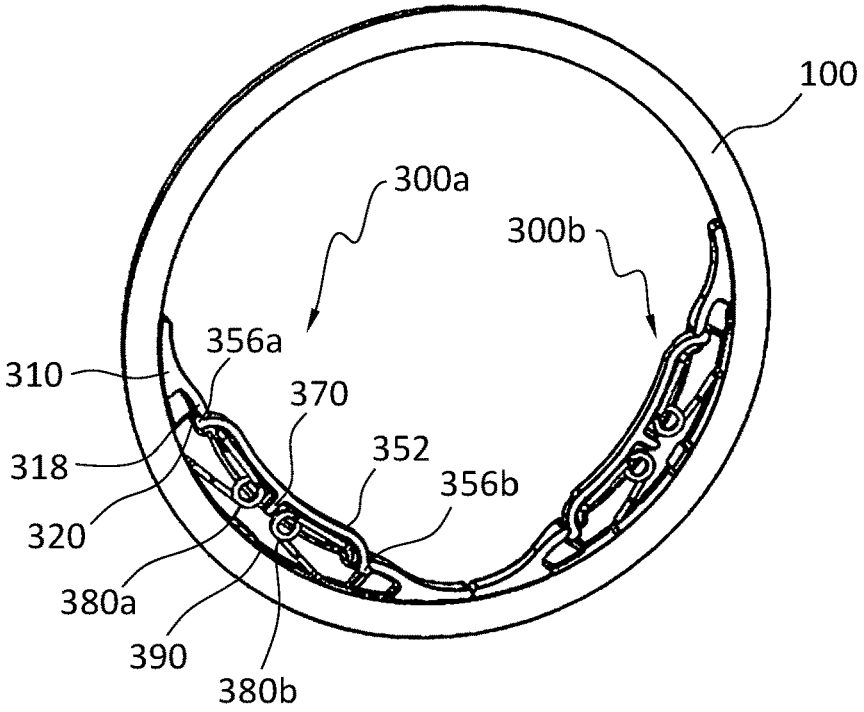
FIG. 13 is a cross-sectional view taken along line 13-13 in FIG. 12.
Figure 14:
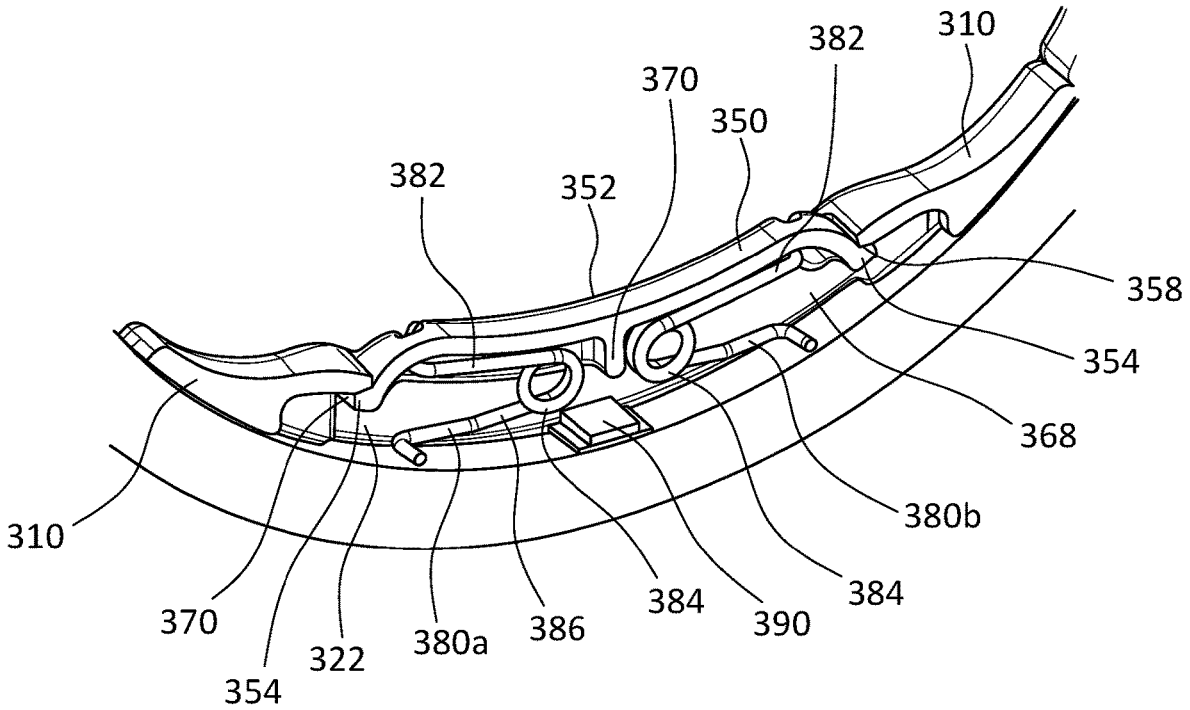
FIG. 14 is an enlarged cross-sectional view in perspective of one ring re-sizing attachment according to the third embodiment.
Figure 15:
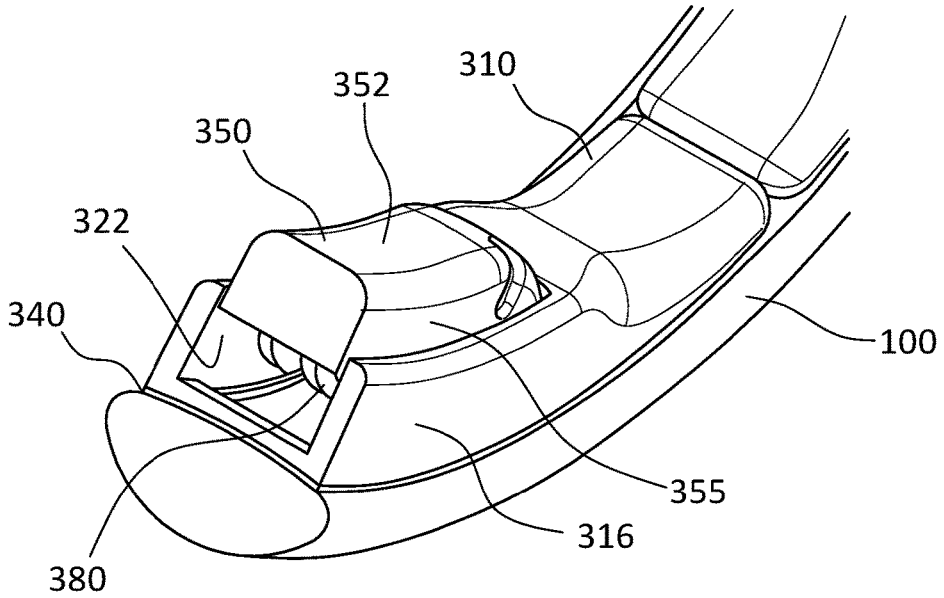
FIG. 15 is an enlarged cross-sectional view in right perspective taken along line 15-15 in FIG. 12.

When the button 250 is urged downwardly against the leaf spring 270, the outwardly downturned curved tip ends 276, 278 of the leaf spring 270 slide in the respective recesses 266, 268 toward the ends of the button 250. As shown in FIG. 11, the leaf spring 270 substantially flattens, as the tip ends 276, 278 remain in contact with the bottom surface 253 of the button 250. The outwardly downturned curved tip ends 276, 278 allow the leaf spring 270 to translate along the bottom surface inside the button 250 as the leaf spring is compressed. The bottom edges of the button 250, such as the bottom ledge contact surfaces 257*a*, 257*b*, move downwardly farther into the inner cavity 222 of the base 210. The button 250 is fully depressed within the cavity of the base 210 when the bottom ledge contact surfaces 257*a*, 257*b* contact the bottom cover 240 (See FIG. 11, which is comparable to what is shown in FIG. 4 in respect of the first embodiment). The compressed leaf spring 270 seats within the inner cavity 260 of the button 250 and does not block the button 250 from achieving its maximum travel in compressed state.

In the third embodiment of a ring re-sizing attachment 300 shown in FIGS. 12-17, two ring re-sizing attachments 300*a*, 300*b* are appended to the band in 100 in spaced apart relation, such as at the 4 o'clock and 8 o'clock locations on the inner surface of the band. Each ring re-sizing attachment 300 has a base 310 with a top surface 312 and a bottom surface 314 opposite the top surface. The base 310 further has a raised wall 316 upstanding from the top surface 312 that surrounds an inner cavity 322 of the base 310. The raised wall 316 defines a curved lip 318*a* at its left end and a curved lip 318*b* at its right end. The bottom surfaces of the curved lips 318*a*, 318*b* form inner ledges 320*a*, 320*b*. The bottom surface 314 of the base 310 preferably is curved to match the curve of an inner circumferential surface of a jewelry ring band 100.

The inner cavity 322 of the base 310 is closed off by a bottom cover 340. The bottom cover 340 may be an elastomeric sheet or polymeric sheet. Adhesive may be applied to append the bottom cover 340 to an inner circumferential surface of a jewelry ring band 100 thereby securing the ring re-sizing attachment 300 to the jewelry ring band 100.

A button 230 has an arcuately curved upper or top surface 352 with a bottom surface 353 opposite the top surface 352. The button 350 has dimensions to slidingly fit within an opening defined by the raised sidewall 316 of the base 310. The sidewalls of the button 350 are positioned closely adjacent to the inner portion of the raised sidewall 326 of the base 310. The ends 354*a*, 354*b* of the button 350 have curved lips 356*a*, 356*b* projecting outwardly from the bottom edges of the ends 354*a*, 354*b*. The curved lips 356*a*, 356*b* have generally planar top surfaces forming ledges 358*a*, 358*b* adapted for contacting the inner ledges 320*a*, 320*b*, respectively, of the curved lips 318*a*, 318*b* of the raised wall 316 of the base 310. As shown in FIGS. 8 and 9, the curved lips 356*a*, 356*b* have bottom contact surfaces 357*a*, 357*b*. The button 350 is retained in the cavity 322 of the base 310 by contact between the ledges 358*a*, 358*b* and the inner ledges 320*a*, 320*b*. The retention features of the button 550 are present only on the button ends (i.e., circumferentially with reference to a jewelry ring band), and not along the sides of the button. With retention features so positioned, the button may be wider, leading to greater wearer comfort due to greater button surface area in contact with the wearer's finger.

The button 350 defines multi-compartment inner cavity 360. A contact rib 270 extends downwardly from the bottom surface 353 of the button 350, thereby creating two compartments in the inner cavity 360. The contact rib 270 has a tip end that is rounded and configured for contacting a stop 390 that is positioned on the opposite side of the bottom surface 314 of the base 310.

In this third embodiment, a first torsional spring 380*a* is held in the first compartment of the inner cavity 360, and a second torsional spring 380*b* is held in the second compartment of the inner cavity 360. Each torsional spring 380 has a spring coil 384 from which a first arm 382 and a second arm 386 extend. The first arm 382 contacts the bottom surface 353 of the button 350, and the second arm 386 contacts the surface opposite the bottom surface 314 of the base 310.

As shown in FIGS. 13-16, the torsional springs 380*a*, 380*b* urge the button 350 upwardly so that the top surface 352 of the button 350 extends above the upraised sidewall 316 of the base 310. The ledges 358*a*, 358*b* of the button 350 contact the inner ledges 320*a*, 320*b* of the upraised sidewall 316 of the base 310, retaining a bottom portion of the button 350 within the inner cavity 322 of the base 310. The first arms 382 of the torsional springs 380 contact the bottom surface 353 of the button 350. The contacts between the first arms 382 and the bottom surface 353 distribute the pushing force over the button 350, making the button 350 more resistant to jamming as the button 350 slidingly moves up (and down) within the inner cavity 322 of the base 310. The torsional springs 380 are retained in the compartments of the inner cavity 360 of the button 350.

Figure 16:
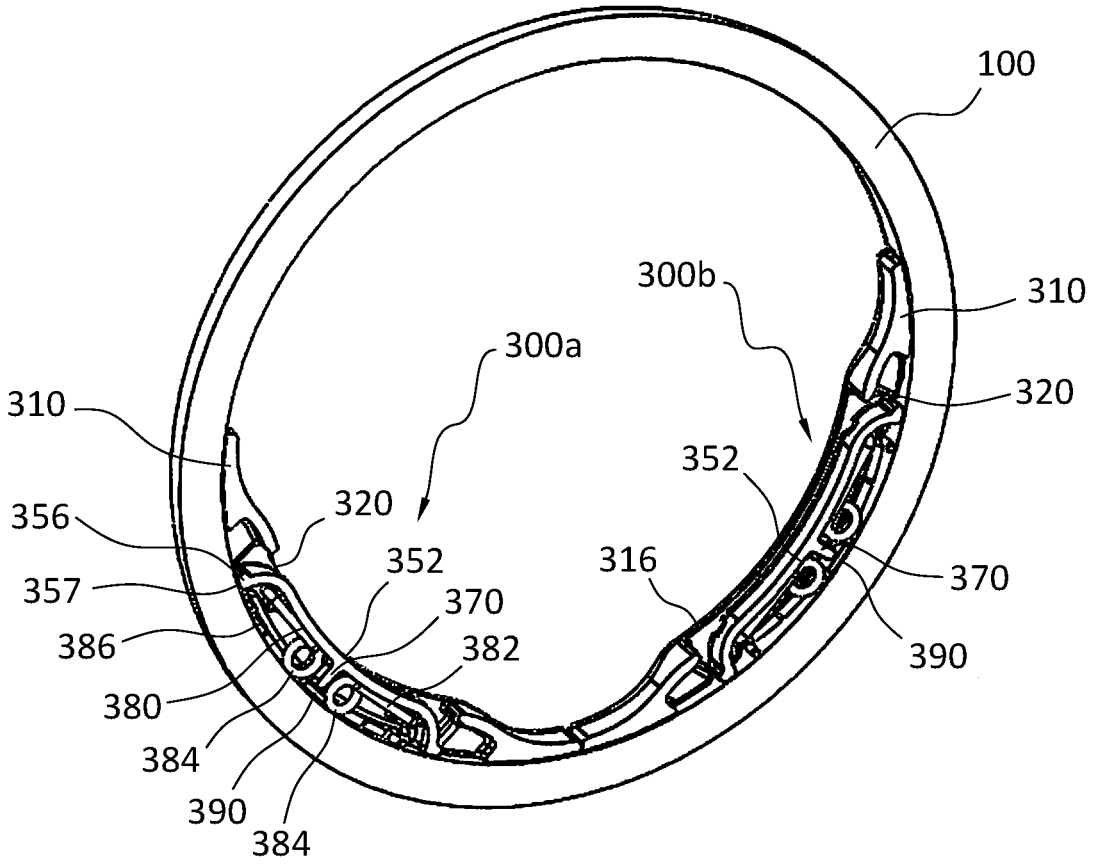
FIG. 16 is a cross-sectional view in right perspective comparable to FIG. 13, and with the buttons of the ring re-sizing attachments compressed.
Figure 17:
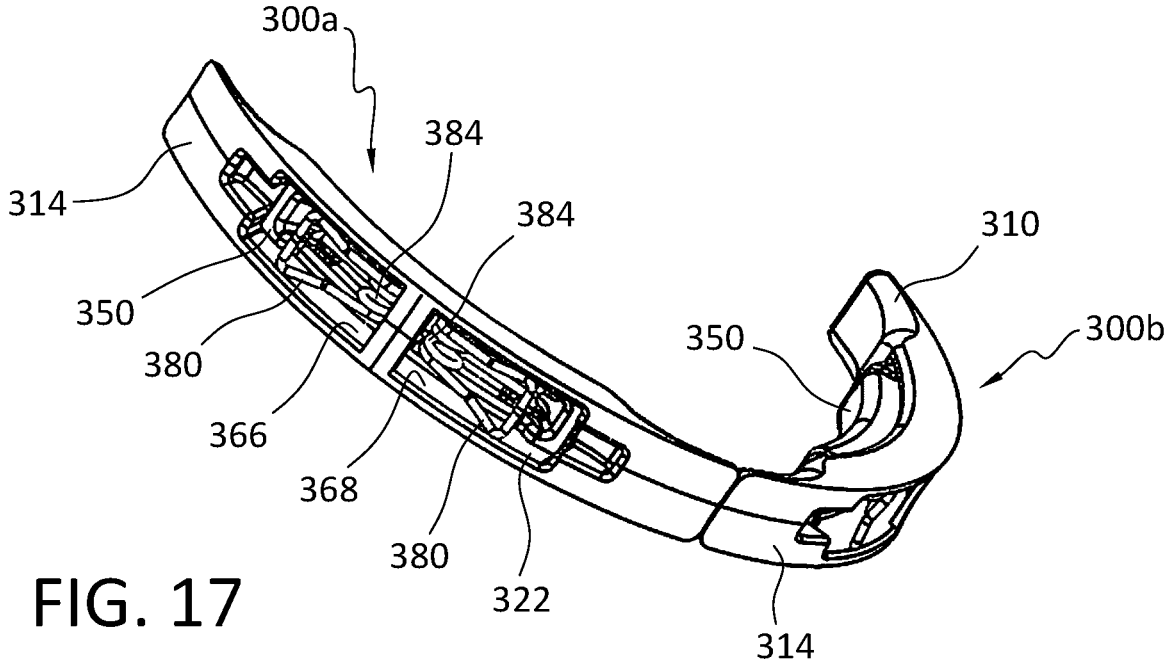
FIG. 17 is an enlarged bottom view in right perspective of the ring re-sizing attachments of FIG. 12 with the bottom covers removed from the ring re-sizing attachments.

When the button 350 is urged downwardly against the torsional springs 380, the first arms 382 of the springs 380 oppose the downward movement, but ultimately are compressed toward the second or bottom spring arms 386. As shown in FIG. 16, the top spring arms 382 come closer to the bottom or second spring arms 386, and the contact rib 370 extending from the bottom surface of the button 350 moves toward the stop 390. At maximum compression, the tip of the contact rib 370 makes contact with the stop 390, as is shown in FIG. 16. As the spring arms 382, 386 are compressed toward one another, the springs 380 remain within the inner cavity 322 of the base 310 and each spring 380 also remains within its individual spring compartment of the inner cavity 360 of the button 350. When the springs are so compressed, the bottom edges of the button 350, such as the bottom ledge contact surfaces 357*a*, 357*b*, move downwardly farther into the inner cavity 322 of the base 310. The button 350 is fully depressed within the cavity of the base 310 when the bottom ledge contact surfaces 357*a*, 357*b* contact the bottom cover 340 and the tip of the contact rib 370 contacts the stop 190 (See FIG. 16). The torsional springs 380 do not block the button 350 from achieving its maximum travel in compressed state.

The ring re-sizing attachments 10, 200, 300 have advantages over the prior art constructions and methods for adjusting ring size. The ring band 100 need not be drilled or modified to receive the ring re-sizing attachments 10, 200, 300. Nor is the ring band 100 marred or weakened by welding or other machining. Nor is any structure contacting the outer circumference of the ring band 100, so the ornamental appearance of the exterior of the ring is not altered. In the preferred embodiments, the ring re-sizing attachments are joined to the inner circumference of the ring band with adhesive. One exemplary suitable adhesive is E6000 medium viscosity industrial perchloroethylene adhesive.

As such, it will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

REFERENCE NUMERALS

10, 10*a*, 10*b* ring re-sizing attachment
20 base
22 top surface of base
24 bottom or opposite surface of base
26 raised wall
28, 28*a*, 28*b* curved lip of base
30, 30*a*, 30*b* inner ledge of base
34 inner cavity of base
40 bottom cover to seal inner cavity of base
50 button
52 arcuate top surface of button
53 bottom or opposite surface of button
54, 54*a*, 54*b* ends of button
55 side wall of button
56, 56*a*, 56*b* curved lip of button
57, 57*a*, 57*b* bottom ledge contact surface of button
58, 58*a*, 58*b* top ledge contact surface of button
60 inner cavity of button
62 left side L-shaped support ribs inside button
64 right side L-shaped support ribs inside button
66 left side spring retaining cavity
68 right side spring retaining cavity
70 leaf spring
72 arcuate bottom of leaf spring
74 arcuate top of leaf spring
76 tip, outwardly curved left end of leaf spring
78 tip, outwardly curved right end of leaf spring
100 jewelry ring band
200, 200*a*, 200*b* ring re-sizing attachment

210 base of ring re-sizing attachment
212 top surface of base
214 bottom surface of base
216 raised wall of base
218, 218*a*, 218*b* curved lip of base
220, 220*a*, 220*b* inner ledge of base
222 inner cavity of base
240 bottom cover to seal base
250 button
252 arcuate top surface of button
253 bottom or opposite surface of button
254, 254*a*, 254*b* end of button
255 side wall of button
256, 256*a*, 256*b* curved lip of button
257, 257*a*, 257*b* bottom ledge contact surface
258, 258*a*, 258*b* top ledge contact surface
260 inner cavity of button
266 left side spring retaining cavity
268 right side spring retaining cavity
270 leaf spring
272 arcuate bottom of leaf spring
274 arcuate top of leaf spring
276 tip, outwardly curved left end of leaf spring
278 tip, outwardly curved right end of leaf spring
300, 300*a*, 300*b* ring re-sizing attachment
310 base
312 top surface of base
314 bottom surface of base
316 raised wall
318, 318*a*, 318*b* curved lip of base
320, 320*a*, 320*b* inner ledge of base
322 inner cavity of base
340 bottom cover to seal base
350 button
352 arcuate top surface of button
353 bottom or opposite surface of button
354, 354*a*, 354*b* end of button
355 side wall of button
356, 356*a*, 356*b* curved lip of button
357, 357*a*, 357*b* bottom ledge contact surface
358, 358*a*, 358*b* top ledge contact surface
360 inner cavity of button
366 left side spring retainer
368 right side spring retainer
370 contact rib of button
380, 380*a*, 380*b* torsional spring
382 top arm of torsional spring
384 spring coil
386 bottom arm of torsional spring
390 stop that is contacted by contact rib

We claim:

1. A ring re-sizing attachment, comprising:

a base having a bottom surface and having a top surface opposite the bottom surface, said base defining an inner cavity with a raised wall surrounding said inner cavity and having a first lip and a second lip projecting from the raised wall into the inner cavity;

a button having an arcuately curved top surface, a bottom surface opposite the top surface and a sidewall depending downwardly from the top surface, said button having a left end and a right end and a lip at the left end and a second lip at the right end, and said button further defining an inner volume wherein said button is slidingly engaged within the inner cavity of the base;

a bottom cover extending over at least the inner cavity of the base, and a leaf spring arranged in the inner cavity of the base, wherein said leaf spring has an arcuately curved top surface, a bottom surface opposite the arcuately curved top surface, and has a first tip end contacting the button, and a second tip end contacting the button, and wherein a portion of a bottom surface of said leaf spring contacts the bottom cover;

wherein said leaf spring is configured to urge the button away from the bottom cover so that a portion of the button projects above the raised wall of the base.

2. The ring re-sizing attachment of claim 1, wherein the first tip end and the second tip end of the leaf spring are curved.

3. The ring re-sizing attachment of claim 1, wherein at least two support ribs project from the bottom surface of the button, and the first end of the leaf spring contacts a first of the two support ribs and the second end of the leaf spring contacts a second of the two support ribs.

4. The ring re-sizing attachment of claim 3, wherein at least four support ribs project from the bottom surface of the button, and wherein the first tip end of the leaf spring contacts two support ribs of the button and wherein the second tip end of the leaf spring contacts two other support ribs of the button.

5. The ring re-sizing attachment of claim 3, wherein each of the support ribs has a bent tip.

6. The ring re-sizing attachment of claim 5, wherein the first tip end of the leaf spring is retained between the bent tip of one of the support ribs and the right end of the button.

7. The ring re-sizing attachment of claim 6, wherein the second tip end of the leaf spring is retained between the bent tip of a second one of the support ribs and the left end of the button.

8. The ring re-sizing attachment of claim 1, further comprising adhesive to append the bottom cover to the inner circumferential surface of a ring band.

9. The ring re-sizing attachment of claim 1, wherein the bottom surface of the button is curved with a radius.

10. The ring re-sing attachment of claim 1, wherein the lip at the left end of the button contacts the first lip of the raised wall of the base when the button is urged upwardly by the leaf spring, and wherein the second lip at the right end of the button contacts the second lip of the raised wall of the base when the button is urged upwardly by the leaf spring.

11. The ring re-sizing attachment of claim 1, wherein the lip at the left end of the button contacts the bottom cover when the button is pushed downwardly against the leaf spring, and wherein the lip at the right end of the button contacts the bottom cover when the button is urged downwardly against the leaf spring.

12. The ring re-sizing attachment of claim 1, wherein the raised wall of the base defines a height, and wherein button defines a height that is substantially the same as the height of the raised wall of the base.

13. The ring re-sizing attachment of claim 12, wherein the arcuately curved top surface of the button is at or below the height of the raised wall of the base when the button is pushed downwardly overcoming the opposite force of the leaf spring.

14. The ring re-sizing attachment of claim 13, wherein the leaf spring remains in the inner volume of the button when the leaf spring is compressed.

15. A jewelry ring, comprising:

a band adapted to fully or substantially fully encircle a user's finger when the jewelry ring is worn, said band defining an inner circumference; and a ring re-sizing attachment appended to the inner circumference, said ring re-sizing attachment comprising: (a) a base having a bottom surface and having a top surface opposite the bottom surface, said base defining an inner cavity with a raised wall surrounding said inner cavity and having a first lip and a second lip projecting from the raised wall into the inner cavity, (b) a button having an arcuately curved top surface, a bottom surface opposite the top surface and a sidewall depending downwardly from the top surface, said button having a left end and a right end and a lip at the left end and a second lip at the right end, and said button further defining an inner volume, wherein said button is slidingly engaged within the inner cavity of the base, (c) a bottom cover extending over at least the inner cavity of the base, and (d) a leaf spring arranged in the inner cavity of the base, wherein said leaf spring has an arcuately curved top surface, a bottom surface opposite the arcuately curved top surface, and has a first tip end contacting the button, and a second tip end contacting the button, and wherein a portion of a bottom surface of said leaf spring contacts the bottom cover, and wherein said leaf spring is configured to urge the button away from the bottom cover so that a portion of the button projects above the raised wall of the base.

16. The jewelry ring of claim 15, wherein the first tip end and the second tip end of the leaf spring are curved.

17. The jewelry ring of claim 15, wherein at least two support ribs project from the bottom surface of the button, and the first end of the leaf spring contacts a first of the two support ribs and the second end of the leaf spring contacts a second of the two support ribs.

18. The jewelry ring of claim 17, wherein each of the support ribs has a bent tip.

19. The jewelry ring of claim 18, wherein the first tip end of the leaf spring is retained between the bent tip of one of the support ribs and the right end of the button.

20. The jewelry ring of claim 19, wherein the second tip end of the leaf spring is retained between the bent tip of a second one of the support ribs and the left end of the button.

21. The jewelry ring of claim 15, wherein at least four support ribs project from the bottom surface of the button, and wherein the first tip end of the leaf spring contacts two support ribs of the button and wherein the second tip end of the leaf spring contacts two other support ribs of the button.

22. The jewelry ring of claim 15, further comprising adhesive to append the bottom cover to the inner circumferential surface of a ring band.

23. The jewelry ring of claim 15, wherein the bottom surface of the button is curved with a radius.

24. The jewelry ring of claim 15, wherein the lip at the left end of the button contacts the first lip of the raised wall of the base when the button is urged upwardly by the leaf spring, and wherein the second lip at the right end of the button contacts the second lip of the raised wall of the base when the button is urged upwardly by the leaf spring.

25. The jewelry ring of claim 15, wherein the lip at the left end of the button contacts the bottom cover when the button is pushed downwardly against the leaf spring, and wherein the lip at the right end of the button contacts the bottom cover when the button is urged downwardly against the leaf spring.

26. The jewelry ring of claim 15, wherein the raised wall of the base defines a height, and wherein the button defines a height that is substantially the same as the height of the raised wall of the base.

27. The jewelry ring of claim 26, wherein the arcuately curved top surface of the button is at or below the height of the raised wall of the base when the button is pushed downwardly overcoming the opposite force of the leaf spring.

28. The jewelry ring of claim 15, wherein the leaf spring remains in the inner volume of the button when the leaf spring is compressed.

29. The jewelry ring of claim 15, further comprising a second ring re-sizing attachment appended to the inner circumference at a location spaced apart from the ring re-sizing attachment.

* * * * *